US009663735B2

(12) United States Patent
Brewer

(10) Patent No.: US 9,663,735 B2
(45) **Date of Patent: *May 30, 2017**

(54) LIQUID FUEL COMPOSITIONS

(71) Applicant: SHELL OIL COMPANY, Houston, TX (US)

(72) Inventor: Mark Lawrence Brewer, Manchester (GB)

(73) Assignee: SHELL OIL COMPANY, Houston, TX (US)

( * ) Notice: Subject to any disclaimer, the term of this patent is extended or adjusted under 35 U.S.C. 154(b) by 18 days.

This patent is subject to a terminal disclaimer.

(21) Appl. No.: 14/521,684

(22) Filed: Oct. 23, 2014

(65) Prior Publication Data

US 2015/0113858 A1 Apr. 30, 2015

(30) Foreign Application Priority Data

Oct. 24, 2013 (EP) ..... 13190062

(51) Int. Cl.

| | |
|---|---|
| ***C10L 1/232*** | (2006.01) |
| ***C10L 1/24*** | (2006.01) |
| ***C10L 10/12*** | (2006.01) |
| ***C10L 1/08*** | (2006.01) |
| ***C10L 1/233*** | (2006.01) |

(52) U.S. Cl.

CPC ..... *C10L 1/232* (2013.01); *C10L 1/08* (2013.01); *C10L 1/233* (2013.01); *C10L 1/2437* (2013.01); *C10L 10/12* (2013.01); *C10L 2200/0259* (2013.01); *C10L 2200/0263* (2013.01); *C10L 2200/0446* (2013.01); *C10L 2270/026* (2013.01); *C10L 2300/20* (2013.01)

(58) Field of Classification Search

CPC ..... C10L 1/232
USPC ..... 44/329–342
See application file for complete search history.

(56) References Cited

U.S. PATENT DOCUMENTS

| | | | | |
|---|---|---|---|---|
| 3,063,819 | A | 11/1962 | Watt et al. | |
| 4,632,674 | A | 12/1986 | Martella | |
| 4,857,073 | A | 8/1989 | Vataru et al. | |
| 5,219,955 | A * | 6/1993 | Sung | C08G 8/08 423/235 |
| 5,322,528 | A * | 6/1994 | Lu-Dai Sung | C07D 251/34 44/336 |
| 5,378,348 | A | 1/1995 | Davis et al. | |
| 5,490,864 | A | 2/1996 | Herbstman et al. | |
| 5,516,341 | A * | 5/1996 | Farng | C10L 1/232 44/331 |
| 5,746,783 | A * | 5/1998 | Compere | C10L 1/328 44/301 |
| 5,766,274 | A | 6/1998 | Wittenbrink et al. | |
| 5,888,376 | A | 3/1999 | Wittenbrink et al. | |
| 6,204,426 | B1 | 3/2001 | Miller et al. | |
| 7,850,744 | B2 * | 12/2010 | Voelkel | C10L 10/08 44/343 |
| 7,858,373 | B2 * | 12/2010 | Banavali | C10L 1/003 436/27 |
| 8,147,566 | B2 * | 4/2012 | Krogh | C10L 1/10 44/301 |
| 8,529,643 | B2 * | 9/2013 | Galante-Fox | C10L 1/221 123/1 A |
| 8,623,105 | B2 * | 1/2014 | Malfer | C10L 1/221 44/331 |
| 8,668,749 | B2 * | 3/2014 | Fang | C07D 213/55 44/331 |
| 9,062,266 | B2 * | 6/2015 | Peretolchin | C10L 1/232 |
| 9,222,047 | B2 * | 12/2015 | Brewer | C10L 1/1852 |
| 2004/0123515 | A1 * | 7/2004 | Krogh | C10L 1/10 44/335 |
| 2008/0182767 | A1 * | 7/2008 | Loper | C07D 233/20 508/222 |
| 2010/0107476 | A1 * | 5/2010 | Cosimbescu | C10L 1/143 44/334 |
| 2010/0107482 | A1 * | 5/2010 | Bennett | C10L 1/143 44/403 |
| 2012/0010112 | A1 | 1/2012 | Grabarse et al. | |
| 2012/0102826 | A1 | 5/2012 | Fang | |
| 2013/0205654 | A1 | 8/2013 | Peretolchin et al. | |
| 2014/0173973 | A1 | 6/2014 | Brewer | |
| 2015/0113857 | A1 * | 4/2015 | Brewer | C10L 1/232 44/336 |

FOREIGN PATENT DOCUMENTS

| | | |
|---|---|---|
| CN | 101921638 | 12/2010 |
| CN | 101928613 | 12/2010 |
| CN | 102977948 | 3/2013 |
| EP | 147240 | 7/1985 |
| EP | 482253 | 4/1992 |
| EP | 557516 | 4/1993 |
| EP | 613938 | 9/1994 |
| EP | 1101813 | 5/2001 |
| EP | 583836 | 2/2002 |
| GB | 960493 | 6/1964 |
| WO | 9533805 | 12/1995 |
| WO | 9603397 | 2/1996 |
| WO | 9714768 | 4/1997 |
| WO | 9714769 | 4/1997 |
| WO | 9801516 | 1/1998 |
| WO | 9842808 | 10/1998 |
| WO | 9932584 | 7/1999 |
| WO | 0011116 | 3/2000 |

(Continued)

OTHER PUBLICATIONS

Sagarin, et al.: Cosmetics Science and Technology, 2nd Edition, vol. 1, Chapter V, p. 189 et seq., 1972.

(Continued)

*Primary Examiner* — Ellen McAvoy

(57) ABSTRACT

Certain UV filter compounds improve the combustion properties of diesel fuel compositions, and in particular modify the ignition delay and/or modify the burn period and/or modify the peak pressure and/or increase the cetane number of the liquid fuel composition. A liquid fuel composition is provided containing:

(a) a diesel base fuel suitable for use in an internal combustion engine; and (b) in the range of 10 ppmw to 2 wt %, by weight of the liquid fuel composition, of one or more organic UV filter compounds selected from imidazoles, triazines, triazones and triazoles, and mixtures thereof.

7 Claims, No Drawings

(56) References Cited

FOREIGN PATENT DOCUMENTS

| | | |
|---|---|---|
| WO | 0011117 | 3/2000 |
| WO | 0020534 | 4/2000 |
| WO | 0020535 | 4/2000 |
| WO | 0183406 | 11/2001 |
| WO | 0183641 | 11/2001 |
| WO | 0183647 | 11/2001 |
| WO | 0183648 | 11/2001 |
| WO | 2006135881 | 12/2006 |
| WO | 2008135602 | 11/2008 |
| WO | 2011095819 | 8/2011 |
| WO | 2011110860 | 9/2011 |
| WO | 2011149799 | 12/2011 |

OTHER PUBLICATIONS

Nei, Danping, et al.: The Lubricity of Diesel Fuels, Wear, III, pp. 217-235, 1986.

International Search Report dated Dec. 10, 2014 of PCT/EP2014/072688 filed Oct. 22, 2014.

Cooper, C., "Triazine Parent Structures", The Organic Chemist's Desk Reference, 2nd Ed., CRC Press, 2010, chapter 4.1.2, p. 72.

State Intellectual Property Office of the People's Republic of China, the 1st Office Action, dated Sep. 5, 2016, for Application No. 201480058056.0.

* cited by examiner

LIQUID FUEL COMPOSITIONS

This present application claims the benefit of European Patent Application Nos. 13190062.1, filed Oct. 24, 2013, the entire disclosures of which are incorporated herein by reference.

FIELD OF THE INVENTION

The present invention relates to a liquid fuel composition, in particular to a liquid fuel composition having improved fuel combustion and increased cetane number.

BACKGROUND OF THE INVENTION

The cetane number of a fuel composition is a measure of its ease of ignition and combustion. With a lower cetane number fuel a compression ignition (diesel) engine tends to be more difficult to start and may run more noisily when cold; conversely a fuel of higher cetane number tends to impart easier cold starting, to lower engine noise, to alleviate white smoke ("cold smoke") caused by incomplete combustion after.

There is a general preference, therefore, for a diesel fuel composition to have a high cetane number, a preference which has become stronger as emissions legislation grows increasingly stringent, and as such automotive diesel specifications generally stipulate a minimum cetane number. To this end, many diesel fuel compositions contain ignition improvers, also known as cetane boost additives or cetane (number) improvers/enhancers, to ensure compliance with such specifications and generally to improve the combustion characteristics of the fuel.

Organic nitrates have been known for some time as ignition accelerants in fuels, and some are also known to increase the cetane number of diesel fuels. Perhaps the most commonly used diesel fuel ignition improver is 2-ethylhexyl nitrate (2-EHN), which operates by shortening the ignition delay of a fuel to which it is added.

However, 2-EHN is also a radical initiator, and can potentially have an adverse effect on the thermal stability of a fuel. Poor thermal stability in turn results in an increase in the products of instability reactions, such as gums, lacquers and other insoluble species. These products can block engine filters and foul fuel injectors and valves, and consequently can result in loss of engine efficiency or emissions control.

The organic nitrates described in the prior art as combustion improvers and/or cetane number improvers have a series of disadvantages, especially lack of thermal stability, excessively high volatility and insufficient efficacy. However, it may be expected that by decreasing the volatility of a cetane enhancer, e.g. by using a molecule of higher molecular weight, its efficacy as a combustion improver and/or cetane number improver may then decline.

There are also health and safety concerns regarding the use of 2-EHN, which is a strong oxidising agent and is also readily combustible in its pure form. It can also be difficult to store in concentrated form as it tends to decompose, and so is prone to forming potentially explosive mixtures. Furthermore, it has been noted that 2-EHN functions most effectively under mild engine conditions.

These disadvantages, taken together with the often significant cost of incorporating 2-EHN as an additive into a fuel composition, mean that it would be generally desirable to reduce or eliminate the need for 2-EHN and other known cetane number improvers in diesel fuel compositions, whilst at the same time maintaining acceptable combustion properties.

CN 101 921 638 A discloses a detergent additive which contains 5 to 20 wt % of an alkyl imidazole as one of the detergent components; the additive is for diesel fuels but in what amount is not clear. U.S. Pat. No. 4,857,073 A discloses the use of about 1 wt % of a tall oil fatty imidazoline in an additive composition, used in minor amounts in a diesel fuel composition, with the purpose of being an ashless detergent and as a component to reduce moisture and resist rust and corrosion in an engine. U.S. Pat. No. 3,063,819 A is primarily concerned with reducing the formation of ice in fuels, such as aviation fuels; but in passing mentions the use of N,C-disubstituted imidazolines as rust inhibitors. CN 102 977 948 A discloses the use of azole compounds in a specific weight ratio to hydrazine compounds and guanidine compounds as a solubiliser for methanol.

SUMMARY OF THE INVENTION

It is desirable to provide cetane enhancers which are effective as combustion improvers or cetane number improvers.

It has now been found that organic UV filter compounds can serve to modify the ignition delay and/or increase the cetane number and/or modify the burn period and/or modify the peak pressure in diesel fuel compositions.

According to an embodiment, there is provided a liquid fuel composition comprising:

(a) a diesel base fuel suitable for use in an internal combustion engine; and (b) one or more organic UV filter compounds selected from the group consisting of imidazoles, triazines, triazones, triazoles, and mixtures thereof.

DETAILED DESCRIPTION OF THE INVENTION

Suitably, the organic UV filter compound has the effect of increasing the cetane number of the diesel fuel composition, such as to a desired or target cetane number. Suitably, the diesel fuel composition has a cetane number of 40 or more, 50 or more, 60 or more, or 70 or more.

In another embodiment, there is provided a method for increasing the cetane number of a diesel fuel composition, which method comprises adding to the composition an amount of an organic UV filter compound selected from the group consisting of imidazoles, triazines, triazones, triazoles, and mixtures thereof.

The method may involve increasing the cetane number of the diesel fuel composition to achieve a target cetane number.

Generally there is provided the use of one, or more, of the above organic UV filter compounds in a diesel fuel composition as a combustion improver.

The uses and methods of the present invention may additionally or alternatively be used to adjust any property of the fuel composition which is equivalent to or associated with cetane number, for example, to improve the combustion performance of the fuel composition, e.g. to modify/shorten ignition delays (i.e. the time between fuel injection and ignition in a combustion chamber during use of the fuel), to facilitate cold starting or to reduce incomplete combustion and/or associated emissions in a fuel-consuming system running on the fuel composition) and/or to improve fuel economy or exhaust emissions generally.

An organic UV filter compound selected from imidazoles, triazines, triazones, triazoles, and mixtures thereof can be used in a diesel fuel composition for modifying the ignition delay of the diesel fuel composition. In such use, the organic UV filter compound is added or blended into a diesel fuel composition. The method includes fuelling an internal combustion engine with such added/blended diesel fuel, and operating said-fuelled internal combustion engine.

In another embodiment, there is provided a method for modifying the ignition delay of a diesel fuel composition, which method comprises adding to the composition an amount of an organic UV filter compound selected from imidazoles, triazines, triazones, triazoles, and mixtures thereof.

In another embodiment, there is provided a method of modifying the ignition delay of a liquid fuel composition used to fuel an internal combustion engine, said method comprising fuelling the internal combustion engine with a liquid fuel composition described herein.

Still yet in another embodiment, a method of operating a compression ignition engine and/or a vehicle which is powered by such an engine, which method involves introducing into a combustion chamber of the engine a diesel fuel composition as described herein; and operating or running such engine containing the diesel fuel composition.

The organic UV filter compound, in a diesel fuel composition may further modifying the burn period of the diesel fuel composition.

In an embodiment, there is provided a method for modifying the burn period of a diesel fuel composition, which method comprises adding to the composition an amount of an organic UV filter compound selected from imidazoles, triazines, triazones, triazoles, and mixtures thereof, and burning.

In an embodiment, there is provided a method of modifying the burn period of a liquid fuel composition used to fuel an internal combustion engine, said method comprising fuelling the internal combustion engine with a liquid fuel composition described herein; and operating such fuelled internal combustion engine.

Suitably, the organic UV filter compound may also have the effect of increasing the power output and acceleration of an internal combustion engine fuelled by a diesel fuel composition of the present invention.

In order to assist with the understanding of the invention several terms are defined herein.

The terms "cetane (number) improver" and "cetane (number) enhancer" are used interchangeably to encompass any component that, when added to a fuel composition at a suitable concentration, has the effect of increasing the cetane number of the fuel composition relative to its previous cetane number under one or more engine conditions within the operating conditions of the respective fuel or engine. As used herein, a cetane number improver or enhancer may also be referred to as a cetane number increasing additive/agent or the like.

In accordance with the present invention, the cetane number of a fuel composition may be determined in any known manner, for instance using the standard test procedure ASTM D613 (ISO 5165, IP 41) which provides a so-called "measured" cetane number obtained under engine running conditions. More preferably the cetane number may be determined using the more recent and accurate "ignition quality test" (IQT; ASTM D6890, IP 498), which provides a "derived" cetane number based on the time delay between injection and combustion of a fuel sample introduced into a constant volume combustion chamber. This relatively rapid technique can be used on laboratory scale (ca 100 ml) samples of a range of different fuels.

Alternatively the Cetane number or derived ignition quality of a fuel can be tested using a Combustion Research Unit (CRU) obtained from Fueltech Solutions AS/Norway. Fuels were injected into a constant volume combustion chamber preconditioned as set conditions.

The Derived Ignition Quality (DIQ) can be determined as a function of Ignition Delay (ID) recorded as the time from start of injection (SOI) to the point where the chamber pressure has risen to 0.2 bar above the pressure before SOI. The Derived Ignition Quality (DIQ) can also be determined as a function of Ignition Delay (ID) recorded as the time from start of injection (SOI) to the point where the chamber pressure equals its initial value plus 5% of maximum pressure increase (MPI). "Burn period" is measured as the time taken from (i) Start of Injection (SOI) to a first chamber pressure; or (ii) from a first chamber pressure to a second chamber pressure, where the pressures are a percentage of the maximum pressure increase (MPI).

Alternatively, cetane number may be measured by near infrared spectroscopy (NIR), as for example described in U.S. Pat. No. 5,349,188. This method may be preferred in a refinery environment as it can be less cumbersome than for instance ASTM D613. NIR measurements make use of a correlation between the measured spectrum and the actual cetane number of a sample. An underlying model is prepared by correlating the known cetane numbers of a variety of fuel samples with their near infrared spectral data.

In some embodiments, the methods/uses encompass adding one or more organic UV filter compounds selected from imidazoles, triazines, triazones and triazoles, and mixtures thereof, to a fuel composition so as to adjust the cetane number or to achieve or reach a desired target cetane number. In the context of the invention, to "reach" a target cetane number can also embrace exceeding that number. Thus, the target cetane number may be a target minimum cetane number.

The present invention suitably results in a fuel composition which has a derived cetane number (IP 498) of 50 or greater, more preferably of 51, 52, 53, 54 or 55 or greater. For example, in some embodiments the resultant fuel composition may have a cetane number of 60 or greater, 65 or greater or even 70 or greater.

The present invention may additionally or alternatively be used to adjust any property of the fuel composition which is equivalent to or associated with cetane number, for example, to improve the combustion performance of the fuel composition, e.g. to shorten ignition delays (i.e. the time between fuel injection and ignition in a combustion chamber during use of the fuel), to facilitate cold starting or to reduce incomplete combustion and/or associated emissions in a fuel-consuming system running on the fuel composition) and/or to improve fuel economy or exhaust emissions generally.

The present invention may also be used herein to modify the burn period. As used herein the term "burn period" means the time between two points in the pressure curve obtained during combustion. Preferably, the burn period modification occurs between any of the following two points:

(i) Start of Injection (SOI)
(ii) 5% burn
(iii) 10% burn
(iv) 20% burn
(v) 30% burn
(vi) 40% burn (vii) 50% burn
(viii) 60% burn
(ix) 70% burn
(x) 80% burn
(xi) 90% burn
(xii) 100% burn.

More preferably, the burn modification occurs between:
(i) SOI and 5% burn
(ii) SOI and 10% burn
(iii) 10% and 50% burn
(iv) 50% and 90% burn
(v) 10% and 90% burn.

Cetane number improvers of the invention may be used to increase the cetane number of a fuel composition. As used herein, an "increase" in the context of cetane number embraces any degree of increase compared to a previously measured cetane number under the same or equivalent conditions. Thus, the increase is suitably compared to the cetane number of the same fuel composition prior to incorporation of the cetane number increasing (or improving) component or additive. Alternatively, the cetane number increase may be measured in comparison to an otherwise analogous fuel composition (or batch or the same fuel composition) that does not include the cetane number enhancer of the invention. Alternatively, an increase in cetane number of a fuel relative to a comparative fuel may be inferred by a measured increase in combustability or a measured decrease in ignition delay for the comparative fuels.

The increase in cetane number (or the decrease in ignition delay, for example) may be measured and/or reported in any suitable manner, such as in terms of a percentage increase or decrease. By way of example, the percentage increase or decrease may be at least 1%, such as at least 2%. Suitably, the percentage increase in cetane number or modification in ignition delay is at least 5%, at least 10%, at least 15% or at least 20%. In some embodiments the increase in cetane number or modification in ignition delay may be at least 25%, at least 30%. However, it should be appreciated that any measurable improvement in cetane number or modification of ignition delay may provide a worthwhile advantage, depending on what other factors are considered important, e.g. availability, cost, safety and so on.

The engine in which the fuel composition of the invention is used may be any appropriate engine. Thus, where the fuel is a diesel or biodiesel fuel composition, the engine is a diesel or compression ignition engine. Likewise, any type of diesel engine may be used, such as a turbo charged diesel engine, provided the same or equivalent engine is used to measure cetane number/ignition delay/burn period with and without the organic UV filter compound. Similarly, the invention is applicable to an engine in any vehicle. Generally, the organic UV filter compounds used in the present invention are suitable for use over a wide range of engine working conditions. However, some organic UV filter compounds used in the present invention may provide optimal effects under a particular narrow range of engine working conditions, such as under mild conditions and more suitably under harsh conditions.

The liquid fuel composition of the present invention comprises a diesel base fuel suitable for use in an internal combustion engine and one or more UV filter compounds selected from imidazoles, triazines, triazones and triazoles, and mixtures thereof. Therefore the liquid fuel composition of the present invention is a diesel composition.

The one or more organic UV filter compounds for use in the gasoline composition of the present invention is selected from imidazoles, triazines, triazones and triazoles, and mixtures thereof.

Suitable imidazoles include, but are not necessarily limited to, disodium phenyl dibenzylimidazole tetrasulfonate, (commercially available from Symrise under the tradename Neoheliopan AP), ethyl hexyl dimethoxybenzylidene dioxoimidazoline propionate, phenylbenzimidazole sulfonic acid (commercially available from DSM under the tradename Parsol HS), and mixtures thereof.

Suitable triazines include, but are not necessarily limited to, phenyl triazines such as bis-ethylhexyloxyphenol methoxyphenyl triazine (commercially available from BASF under the tradename Tinasorb S), bis benzoxazoyl phenyl ethylhexyl aminotriazine (commercially available from 3V Sigma under the tradename Uvasorb K2A), and mixtures thereof.

Suitable triazoles include, but are not necessarily limited to, drometrizole (commercially available from BASF under the tradename Tinuvin P) and ethylene bis-benzotriazolyl tetramethlbutylphenol (commercially available from BASF under the tradename Tinosorb M), and mixtures thereof.

Suitable triazones, include, but are not necessarily limited to, diethyl hexyl butamido triazone (commercially available from 3V Sigma under the tradename Uvasorb HEB), ethyl hexyl triazone (commercially available from BASF under the tradename Uvinul T150), and mixtures thereof.

The amount of the one or more organic UV filter compounds in the liquid fuel composition is suitably at most 2 wt %, by weight of the liquid fuel composition. The amount of the one or more organic UV filter compounds is suitably at least 10 ppmw, by weight of the liquid fuel composition. The amount of the one or more organic UV filter compounds is preferably in the range of from 1 wt % to 0.005 wt %, more preferably in the range of from 0.5 wt % to 0.01 wt %, even more preferably in the range of from 0.05 wt % to 0.01 wt %, by weight of the liquid fuel composition.

Where a combination of two or more organic UV filter compounds is used in the fuel composition, the same concentration ranges may apply to the total combination of organic UV filter compounds. It will be appreciated that amounts/concentrations may also be expressed as ppm, in which case 1% w/w corresponds to 10,000 ppm w/w.

The organic UV filter compound may be blended together with any other additives e.g. additive performance package(s) to produce an additive blend. The additive blend is then added to a base fuel to produce a liquid fuel composition. The amount of organic UV filter compound in the additive blend is preferably in the range of from 0.1 to 99.8 wt %, more preferably in the range of from 5 to 70 wt %, by weight of the additive blend.

The amount of performance package(s) in the additive blend is preferably in the range of from 0.1 to 99.8 wt %, more preferably in the range of from 5 to 50 wt %, by weight of the additive blend.

Preferably, the amount of the performance package present in the liquid fuel composition of the present invention is in the range of 15 ppmw (parts per million by weight) to 10% wt, based on the overall weight of the liquid fuel composition. More preferably, the amount of the performance package present in the liquid fuel composition of the present invention additionally accords with one or more of the parameters (i) to (xv) listed below:
(i) at least 100 ppmw
(ii) at least 200 ppmw
(iii) at least 300 ppmw (iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt
(xv) at most 5% wt.

Typically, the additive blend containing the organic UV filter compound and the additive (performance) package may additionally contain other additive components such as detergents, anti-foaming agents, corrosion inhibitors, dehazers etc. Alternatively, the organic UV filter compound may be blended directly with the base fuel.

The remainder of the composition will typically consist of one or more automotive base fuels optionally together with one or more fuel additives, for instance as described in more detail below.

The relative proportions of the one or more organic sunscreen compounds, fuel components and any other components or additives present in a diesel fuel composition prepared according to the invention may also depend on other desired properties such as density, emissions performance and viscosity.

The diesel fuel used as the base fuel in the present invention includes diesel fuels for use in automotive compression ignition engines, as well as in other types of engine such as for example off road, marine, railroad and stationary engines. The diesel fuel used as the base fuel in the liquid fuel composition of the present invention may conveniently also be referred to as 'diesel base fuel'.

The diesel base fuel may itself comprise a mixture of two or more different diesel fuel components, and/or be additivated as described below.

Conventionally diesel base fuels are present in a diesel or liquid fuel composition in a major amount, for example greater than 50 wt % of the liquid fuel composition, and may be present in an amount of up to 90 wt %, or 95 wt %, or 99 wt %, or 99.9 wt %, or 99.99 wt %, or 99.999 wt %. Suitable the liquid fuel composition contains or consists essentially of the diesel base fuel in conjunction with the one or more organic UV filter compounds, and optionally one or more conventional diesel fuel additives, such as specified hereinafter.

Such diesel fuels will contain one or more base fuels which may typically comprise liquid hydrocarbon middle distillate gas oil(s), for instance petroleum derived gas oils. Such fuels will typically have boiling points within the usual diesel range of 150 to 400 C, depending on grade and use. They will typically have a density from 750 to 1000 kg/m$^3$, preferably from 780 to 860 kg/m$^3$, at 15 C (e.g. ASTM D4502 or IP 365) and a cetane number (ASTM D613) of from 35 to 120, more preferably from 40 to 85. They will typically have an initial boiling point in the range 150 to 230 C and a final boiling point in the range 290 to 400 C. Their kinematic viscosity at 40 C (ASTM D445) might suitably be from 1.2 to 4.5 mm$^2$/s.

An example of a petroleum derived gas oil is a Swedish Class 1 base fuel, which will have a density from 800 to 820 kg/m$^3$ at 15 C (SS-EN ISO 3675, SS-EN ISO 12185), a T95 of 320 C or less (SS-EN ISO 3405) and a kinematic viscosity at 40 C (SS-EN ISO 3104) from 1.4 to 4.0 mm$^2$/s, as defined by the Swedish national specification ECl.

Optionally, non-mineral oil based fuels, such as biofuels or Fischer-Tropsch derived fuels, may also form or be present in the diesel fuel. Such Fischer-Tropsch fuels may for example be derived from natural gas, natural gas liquids, petroleum or shale oil, petroleum or shale oil processing residues, coal or biomass.

The amount of Fischer-Tropsch derived fuel used in the diesel fuel may be from 0% to 100% v of the overall diesel fuel, preferably from 5% to 100% v, more preferably from 5% to 75% v. It may be desirable for such a diesel fuel to contain 10% v or greater, more preferably 20% v or greater, still more preferably 30% v or greater, of the Fischer-Tropsch derived fuel. It is particularly preferred for such diesel fuels to contain 30 to 75% v, and particularly 30 to 70% v, of the Fischer-Tropsch derived fuel. The balance of the diesel fuel is made up of one or more other diesel fuel components.

Such a Fischer-Tropsch derived fuel component is any fraction of the middle distillate fuel range, which can be isolated from the (optionally hydrocracked) Fischer-Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400 C, preferably to about 370 C. Examples of Fischer-Tropsch derived kerosene and gas oils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. No. 5,766,274, U.S. Pat. No. 5,378,348, U.S. Pat. No. 5,888,376 and U.S. Pat. No. 6,204,426.

The Fischer-Tropsch product will suitably contain more than 80 wt % and more suitably more than 95 wt % iso and normal paraffins and less than 1 wt % aromatics, the balance being naphthenics compounds. The content of sulphur and nitrogen will be very low and normally below the detection limits for such compounds. For this reason the sulphur content of a diesel fuel composition containing a Fischer-Tropsch product may be very low.

The diesel fuel composition preferably contains no more than 5000 ppmw sulphur, more preferably no more than 500 ppmw, or no more than 350 ppmw, or no more than 150 ppmw, or no more than 100 ppmw, or no more than 70 ppmw, or no more than 50 ppmw, or no more than 30 ppmw, or no more than 20 ppmw, or most preferably no more than 10 ppmw sulphur.

Other diesel fuel components for use herein include the so-called "biofuels" which derive from biological materials. Examples include fatty acid alkyl esters (FAAE). Examples of such components can be found in WO2008/135602.

The diesel base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

Detergent-containing diesel fuel additives are known and commercially available. Such additives may be added to diesel fuels at levels intended to reduce, remove, or slow the build-up of engine deposits.

Examples of detergents suitable for use in diesel fuel additives for the present purpose include polyolefin substituted succinimides or succinamides of polyamines, for instance polyisobutylene succinimides or polyisobutylene amine succinamides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

Other examples of detergents suitable for use in diesel fuel additives for the present purpose include compounds having at least one hydrophobic hydrocarbon radical having a number-average molecular weight (Mn) of from 85 to 20,000 and at least one polar moiety selected from:

(A1) mono- or polyamino groups having up to 6 nitrogen atoms, of which at least one nitrogen atom has basic properties; and/or (A9) moieties obtained by Mannich reaction of substituted phenols with aldehydes and mono- or polyamines.

Other detergents suitable for use in diesel fuel additives for the present purpose include quaternary ammonium salts such as those disclosed in US2012/0102826, US2012/0010112, WO2011/149799, WO2011/110860, WO2011/095819 and WO2006/135881.

The diesel fuel additive mixture may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide, those peroxide compounds disclosed in WO96/03397 and WO99/32584 and those ignition improvers disclosed in US-A-4208190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; organic sunscreen compound, and wax anti-settling agents.

The diesel fuel additive mixture may contain one or more organic sunscreen compounds, such as those disclosed in European patent application no. 12199119.4.

There is no particular limitation on the type of organic sunscreen compound which can be used in the diesel fuel additive mixture as long as it is suitable for use in a diesel composition.

A wide variety of conventional organic sunscreen actives are suitable for use herein. Sagarin, et al., at Chapter VIII, pages 189 et seq., of Cosmetics Science and Technology (1972), discloses numerous suitable actives.

Particularly preferred hydrophobic organic sunscreen actives useful in the composition of the present invention include: (i) alkyl β,β-diphenylacrylate and/or alpha-cyano-beta,beta-diphenylacrylate derivatives; (ii) salicylic derivatives; (iii) cinnamic derivatives; (iv) dibenzoylmethane derivatives; (v) camphor derivatives; (vi) benzophenone derivatives; (vii) p-aminobenzoic acid derivatives; and (viii) phenalkyl benzoate derivatives; and mixtures thereof.

Preferred alpha-cyano-beta,beta-diphenylacrylate derivatives include ethyl 2-cyano-3,3-diphenylacrylate, 2-ethylhexyl 2-cyano-3,3-diphenylacrylate, and mixtures thereof. More preferably the alpha-cyano-beta,beta-diphenylacrylate derivative is 2-ethylhexyl 2-cyano-3,3-diphenylacrylate, of which the International Non Proprietary Name is Octocrylene. 2-ethylhexyl 2-cyano-3,3-diphenylacrylate is commercially available under the tradename Parsol 340® from DSM Nutritional Products, Inc.

Preferred salicylate derivatives include ethylhexyl salicylate (octyl salicylate), triethanolamine salicylate, 3,3,5-trimethylcyclohexylsalicylate, homomenthyl salicylate, and mixtures thereof. More preferably, the salicylate derivative is ethylhexyl salicylate. Ethylhexyl salicylate is commercially available under the tradename Parsol EHS® from DSM Nutritional Products, Inc.

Preferred cinnamic derivatives are selected from octylmethoxy cinnamate, diethanolamine methoxycinnamate, and mixtures thereof. A particularly preferred cinnamic derivative for use herein is octylmethoxy cinnamate. Octylmethoxy cinnamate is commercially available under the tradename Parsol MCX® from DSM Nutritional Products, Inc.

Preferred dibenzoylmethane derivatives for use herein are selected from butyl methoxy dibenzoylmethane, ethylhexyl methoxy dibenzoylmethane, isopropyl dibenzoylmethane, and mixtures thereof. A particularly preferred dibenzoylmethane derivative for use herein is butyl methoxy dibenzoylmethane. Butyl methoxy dibenzoylmethane is commercially available under the tradename Parsol 1789® from DSM Nutritional Products, Inc.

A preferred camphor derivative for use herein is 4-methylbenzylidene camphor. 4-methylbenzylidene camphor is commercially available under the tradename Parsol 5000® from DSM Nutritional Products, Inc.

Preferred benzophenone derivatives for use herein are selected from benzophenone-1, benzophenone-2, benzophenone-3, benzophenone-4, benzophenone-5, benzophenone-6, benzophenone-7, benzophenone-8, benzophenone-9, benzophenone-10, benzophenone-11, benzophenone-12, and mixtures thereof. A particularly preferred benzophenone derivative for use herein is benzophenone-3. Benzophenone-3 is commercially available under the tradename Escalol 567® from Ashland Specialty Ingredients.

A preferred phenalkyl benzoate derivatives for use herein is phenethyl benzoate. Phenethyl benzoate is commercially available under the tradename X-tend 229® from Ashland Specialty Ingredients.

The amount of the one or more organic sunscreen compounds in the liquid fuel composition is suitably at most 2 wt %, by weight of the liquid fuel composition. The amount of the one or more organic sunscreen compounds is suitably at least 10 ppmw, by weight of the liquid fuel composition. The amount of the one or more organic sunscreen compounds is preferably in the range of from 1 wt % to 0.005 wt %, more preferably in the range of from 0.5 wt % to 0.01 wt %, even more preferably in the range of from 0.05 wt % to 0.01 wt %, by weight of the liquid fuel composition.

The diesel fuel additive mixture may contain a lubricity enhancer, especially when the diesel fuel composition has a low (e.g. 500 ppmw or less) sulphur content. In the additivated diesel fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

the paper by Danping Wei and H. A. Spikes, "The Lubricity of Diesel Fuels", Wear, III (1986) 217-235;

WO-A-95/33805—cold flow improvers to enhance lubricity of low sulphur fuels;

U.S. Pat. No. 5,490,864—certain dithiophosphoric diester-dialcohols as anti-wear lubricity additives for low sulphur diesel fuels; and WO-A-98/01516—certain alkyl aromatic compounds having at least one carboxyl group attached to their aromatic nuclei, to confer anti-wear lubricity effects particularly in low sulphur diesel fuels.

It may also be preferred for the diesel fuel composition to contain an anti-foaming agent, more preferably in combination with an anti-rust agent and/or a corrosion inhibitor and/or a lubricity enhancing additive.

Unless otherwise stated, the (active matter) concentration of each such optional additive component in the additivated diesel fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the diesel fuel composition will preferably be in the range from 0.1 to 20 ppmw, more preferably from 1 to 15 ppmw, still more preferably from 1 to 10 ppmw, and especially from 1 to 5 ppmw. The (active matter) concentration of any ignition improver (e.g. 2-EHN) present will preferably be 2600 ppmw or less, more preferably 2000 ppmw or less, even more preferably 300 to 1500 ppmw. The (active matter) concentration of any detergent in the diesel fuel composition will preferably be in the range from 5 to 1500 ppmw, more preferably from 10 to 750 ppmw, most preferably from 20 to 500 ppmw.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the diesel fuel composition may be suitably between 0 and 10000 ppmw and preferably below 5000 ppmw.

In the above, amounts (concentrations, % vol, ppmw, % wt) of components are of active matter, i.e. exclusive of volatile solvents/diluent materials.

The liquid fuel composition of the present invention is produced by admixing the essential one or more organic UV filter compounds with a diesel base fuel suitable for use in an internal combustion engine. Since the base fuel to which the essential fuel additive is admixed is a diesel, then the liquid fuel composition produced is a diesel composition.

It has surprisingly been found that the use of one or more organic UV filter compounds selected from imidazoles, triazines, triazones and triazoles, and mixtures thereof, in liquid fuel compositions provides benefits in terms of increased cetane number, and generally in terms of combustion improvement, such as by modified ignition delay and/or modified burn period.

The present invention will be further understood from the following examples. Unless otherwise stated, all amounts and concentrations disclosed in the examples are based on weight of the fully formulated fuel composition.

Examples

Certain organic UV filter compounds are blended at 5000 ppm and 500 ppm into a standard low sulphur diesel fuel compliant with EN590. The organic UV filter compounds used in the examples are phenylbenzimidazole sulfonic acid (commercially available from DSM under the tradename Parsol HS), bis-ethylhexyloxyphenol methoxyphenyl triazine (commercially available from BASF under the tradename Tinasorb S), drometrizole, (commercially available from BASF under the tradename Tinuvin P) and ethyl hexyl triazone (commercially available from BASF under the tradename Uvinul T150). Each diesel fuel composition contains one of these organic UV filter compounds at a treat rate of 5000 ppm and 500 ppm.

Under some engine operating conditions, the organic UV filter compounds can provide an increase in cetane number and can modify the ignition delay, peak pressure and/or burn period of a diesel base fuel.

I claim:

1. A liquid fuel composition comprising:

a) a diesel base fuel suitable for use in an internal combustion engine; and b) in the range of from 10 ppmw to 2 wt %, by weight of the liquid fuel composition, of one or more organic UV filter compounds selected from the group consisting of disodium phenyl dibenzylimidazole tetrasulfonate, phenylbenzimidazole sulfonic acid, triazines, triazones, triazoles, and mixtures thereof.

2. The liquid fuel composition of claim 1 wherein the triazines are selected from phenyl triazines.

3. The liquid fuel composition of claim 2 wherein the phenyl triazines are selected from the group consisting of bis-ethylhexyloxyphenol methoxyphenyl triazine, bis benzoxazoyl phenyl ethylhexyl amino, and mixtures thereof.

4. The liquid fuel composition of claim 1 wherein the triazones are selected from the group consisting of diethyl hexyl butamido triazone, ethyl hexyl triazone, and mixtures thereof.

5. The liquid fuel composition of claim 1 wherein the triazoles are selected from the group consisting of drometrizole, ethylene bis-benzotriazolyl tetramethylbutylphenol, and mixtures thereof.

6. A method for modifying the ignition delay and/or increasing the cetane number and/or modifying the burn period and/or modifying the peak pressure of a diesel fuel composition, which method comprises adding to the diesel fuel composition an amount of an organic UV filter compound selected from disodium phenyl dibenzylimidazole tetrasulfonate, phenylbenzimidazole sulfonic acid, triazines, triazones, triazoles, and mixtures thereof.

7. A method of operating a compression ignition engine and/or a vehicle which is powered by such an engine, which method involves introducing into a combustion chamber of the engine a diesel fuel composition of claim 1; and operating said engine containing the diesel fuel composition.

* * * * *